US006347439B1

(12) United States Patent
Bach Lahor

(10) Patent No.: US 6,347,439 B1
(45) Date of Patent: Feb. 19, 2002

(54) SELF-MOUNTABLE NICHE FOR REMAINS ASHES

(76) Inventor: Santiago Bach Lahor, Placeta de la Creu 15, 08221 Terrassa (Barcelona) (ES)

( * ) Notice: Subject to any disclaimer, the term of this patent is extended or adjusted under 35 U.S.C. 154(b) by 0 days.

(21) Appl. No.: 09/573,792

(22) Filed: May 17, 2000

(30) Foreign Application Priority Data

May 17, 1999 (ES) ..... 9901259 U

(51) Int. Cl.[7] ..... A61G 17/00
(52) U.S. Cl. ..... 27/1; 52/134; 52/136
(58) Field of Search ..... 27/1, 35; 52/128, 52/133, 134, 136, 139

(56) References Cited

U.S. PATENT DOCUMENTS 3,183,574 A * 5/1965 Diem ..... 27/1
3,754,805 A * 8/1973 Pangburn et al. ..... 52/136 X
3,925,944 A * 12/1975 Pickel ..... 52/134
4,607,417 A * 8/1986 Hancovsky ..... 27/1
5,625,933 A * 5/1997 Neuberger et al. ..... 27/1
5,740,637 A * 4/1998 Snow ..... 27/1 X
5,950,288 A * 9/1999 Bach Lahor ..... 27/1
6,161,268 A * 12/2000 Joseph ..... 27/35
6,167,600 B1 * 1/2001 Williams et al. ..... 27/1

* cited by examiner

*Primary Examiner*—B. Dayoan
*Assistant Examiner*—William L. Miller
(74) *Attorney, Agent, or Firm*—Michael J. Striker

(57) ABSTRACT

A self-mountable niche for remain ashes has a substantially closed box, a receptacle for accommodating ashes and insertable in the box, a supporting element connected with the box and supporting the latter, and a fastening and locking element connected with the supporting element for placing the niche at a corresponding location.

10 Claims, 3 Drawing Sheets

SELF-MOUNTABLE NICHE FOR REMAINS ASHES

BACKGROUND OF THE INVENTION

The present invention relates to niches for remains ashes, designed to suitably contain and preserve the ashes of a person or a pet.

Nowadays a higher number of people wish their bodies to be incinerated in the moment of their death and to have the ashes preserved for relatives or to be deposited in special places.

Persons in charge of administration of this procedure provide areas where the ashes can be correctly and unmistakably deposited with the use of devices which guarantee its reliability and resistance against external agents.

SUMMARY OF THE INVENTION

Accordingly, it is an object of the present invention to provide a self-mountable niche for remain ashes which is an improvement of existing niches.

In keeping with these objects and with others which will become apparent hereinafter, one feature of present invention resides, briefly stated, in a self-mountable niche for remain ashes which has a substantially closed box; a receptacle for accommodating ashes and insertable in the box; a supporting element connected with the box and supporting the latter; and a fastening and locking element connected with the supporting element for placing the niche at a corresponding location.

When the niche is designed in accordance with present invention, it is formed as an easy-to-use device, in which the receptacle with the ashes can be quickly arranged and which can be placed in a place designed for its location with full guarantee of reliability of its contents.

The inventive niche for remain ashes which is easy to assembly by correlation of its several elements, so that they take a minimum space and provide outstanding beauty of its design and assembly.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
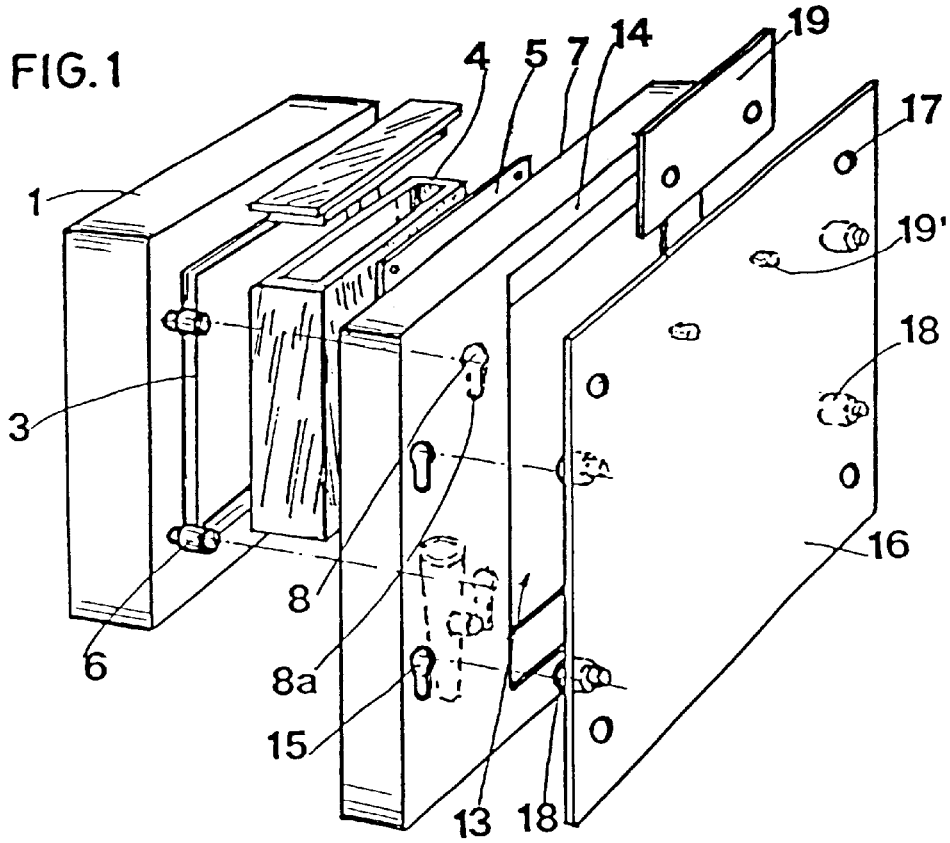
FIG. 1 is a perspective exploded view of a niche in accordance with the present invention.
Figure 2:
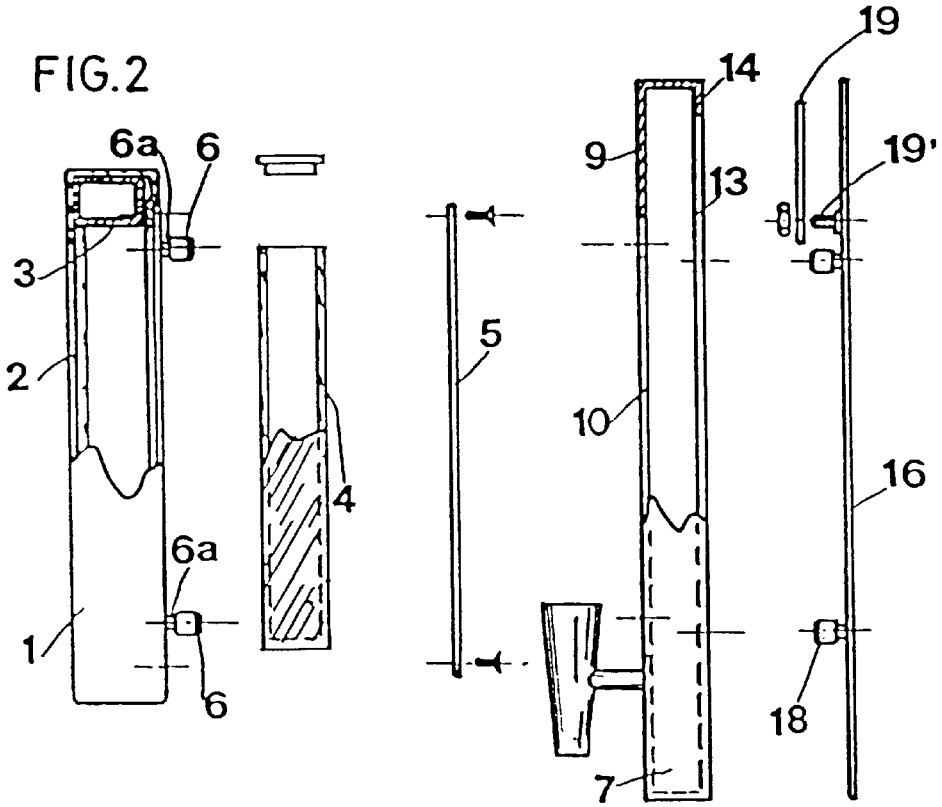
FIG. 2 is a view showing a sectional exploded view of the inventive niche.
Figure 3:
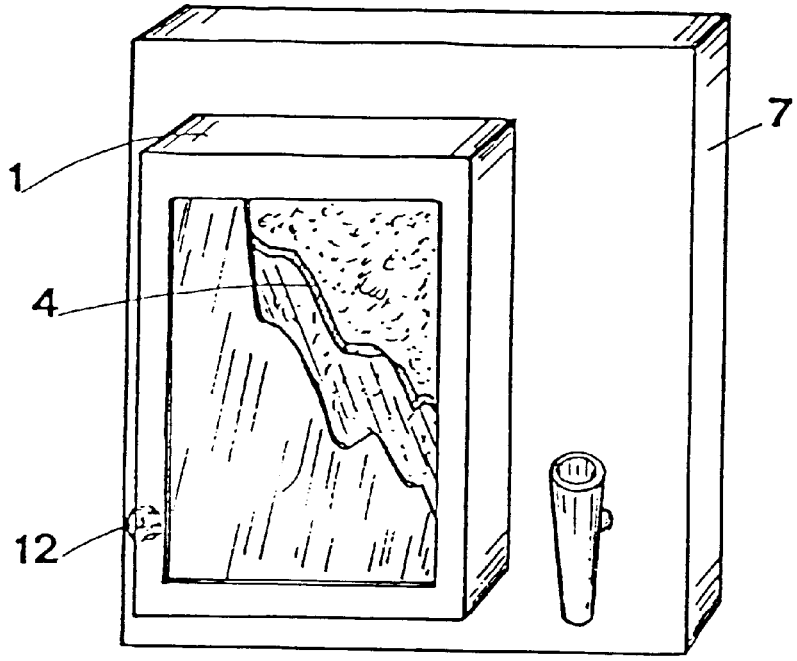
FIG. 3 is a front perspective view of a niche which is partially truncated in accordance with the present invention.
Figure 4:
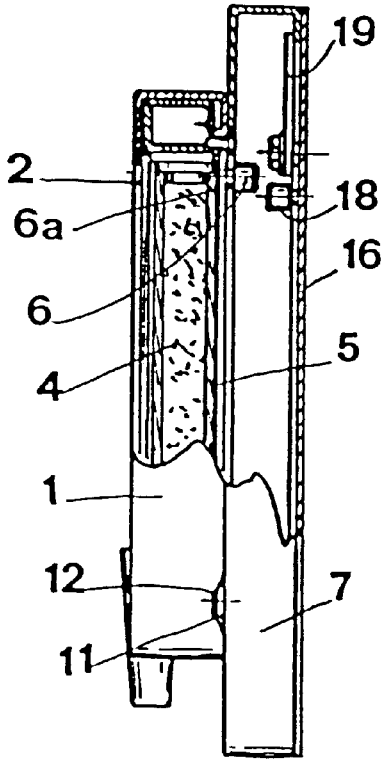
FIG. 4 is a partially sectioned view of the niche in mounted conditions.

A self mountable niche in accordance with the present invention is formed as a closed element in which the ashes are deposited and preserved, a body or supporting and fastening element, and a base for fastening and locking the niche of the place or location either in a sole funeral assembly for several niches or on a surface of a funeral block or the like.

The closed element of the element niche is formed as a regular presmatic-shaped Box 1 with a front face provided with a large opening 2. The opening can be rectangular and closed with a glass which is not shown in the drawings. Walls 3 are provided at four sides and limit a space inside the box. A receptacle 4 can be arranged in the thusly delimited space and contains the ashes. Then the box with the receptacle inside is closed by a cover 5 and firmly retained between the cover and the edges which surround the front opening 2.

The box 1 at the back is provided with cylindrical pins 6. With the cylindrical pins the box 1 can be placed and locked on a supporting and fastening body 7. The pins have a slight narrowing 6*a* so that they can remain engaged through related key hole-shaped holes 8 in the supporting body 7 at its front face 9. The holes have a larger upper part which allows the head of the pins 6 to enter, while the narrower part 6*a* of the pins is accommodated in the lower narrower area 8*a* of the holes. The supporting and fastening element 7 is preferably regular prismatic-shaped. It has at its front face 9*a* rectangular opening 10 surrounded by the holes 8 for fastening of the box 1 with the receptacle 4.

When the box 1 is located and fastened to the supporting body 7, the front opening 10 remains fully covered, while the closed box 1 is locked by a sliding bolt 11 supported against the cylindrical pin 6. This prevents upward movement so that the box 1 can not displace upwardly, while the pins 6 can not exit from the holes 8 in which they are introduced. The sliding bolt 11 is accessible from outside. It is actuated by a known tool, such as for example a latch key 12.

The back face of the supporting body 7 has a large rectangular opening 13 surrounded by a narrow rib 14. The rib extends along the sides as well as the upper and lower faces of the supporting body. Holes 15 are provided in the rib and arranged symmetrically in correspondence with the holes 8 at the front face 9. The arrangement of the holes 15 allows to place and fasten and also to lock the supporting body 7 on the locking base 16 of the niche assembly. The locking base 16 is rectangular and has sides which are identical to the sides of the back face of the supporting body 7. It is provided with holes 17 for bolts, screws or the like, for locking it against a surface where the niche assembly is to be placed.

The locking base is also provided with cylindrical emerging pins 18 similar to the pins 6 of the box 1. The pins 18 are placed so that they coincide with the holes 15 of the supporting body 7. Therefore the supporting body can be locked on the locking base 16 by introducing the holes on the corresponding pins 18.

Finally, the locking base 16 has a retaining means which acts as a locking device. The returning means include a rectangular plate 19 which is locked at the upper part of the locking base 16 and on the face which faces the interior of the niche assembly.

When the supporting body 7 is placed on the pins 18 of the locking base 16, a locking plate 19 is arranged instead of it, to prevent lifting of the supporting body with subsequent detachment and removal of the pins, since the locking plate 19 locks the upper edge of the rib 14 of the supporting body 7. The plate 19 remains joined to the base 16 by screws and nuts 19'.

Figure 5:
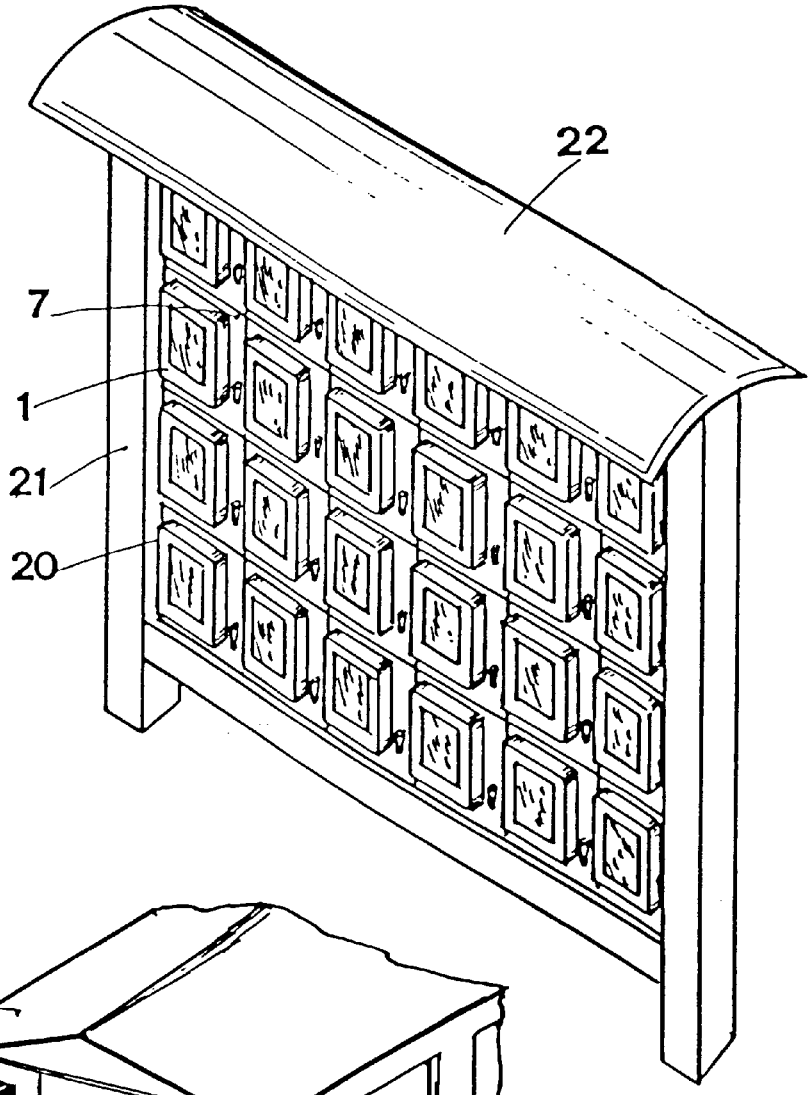
FIG. 5 is a view showing a practical use of plurality of the niches in accordance with the present invention, which form a multiple assembly on a supporting element.
Figure 6:
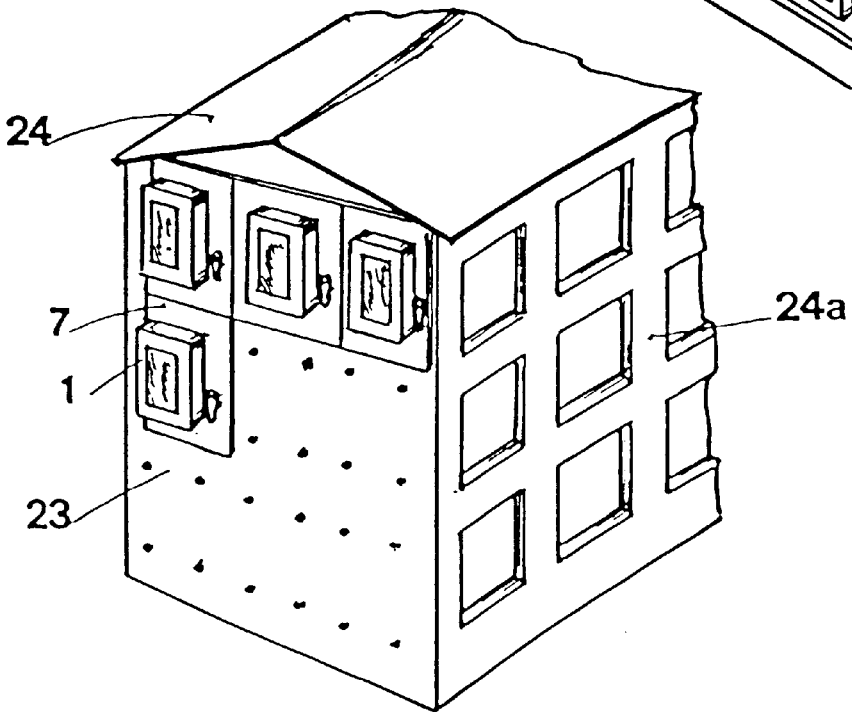
FIG. 6 is a view showing another possibility of a use of the inventive niche by placing the niches on sides a normal funeral block or module.

The locking base 16 can be connected to a surface of a special module 20 together with the rest of the niche assembly and the supporting body 7 with the closed box 1. A plurality of the assemblies are locked on the surface of the module close to each other in perfect continuity, with niche side faces of the supporting bodies 7 coinciding with one another. Thereby horizontal and vertical rows are formed. The special module described herein above is shown in FIG. 5. It has side supporting feets and a protecting and ornamental larmier 22.

In accordance with another embodiment of the invention, the niches can be located on a free side wall 23 of a normal funeral module 24 which is provided with corresponding rows of niches 24*a*. During the placement of the niches on the wall, the corresponding bases 16 are locked in corresponding areas.

When the niche assembly in view of its self mountable nature is placed at the corresponding location, as well as on the special module, they are fastened by bolt or screws of the locking base 16, then the supporting body 7 is placed on it, its back holes 17 are engaged on the cylindrical pins 18 of the base 16, and the locking plate 19 is placed to prevent withdrawal of the supporting body 7. Then with the ashes contained in the closed box 1 the box is located on the supporting body 7, the cylindrical pius 6 engage in the holes 8, the latch 11 is driven by the deadlock 12, one of the cylindrical pins 6 remains fastened, and it is impossible to withdraw the closed box.

The niches for ashes of people and pets have the same construction but just different sizes.

It is possible to provide ornamentation of the assembly For example a drawing sheet, a photograph or the like can be placed on the front face under the glass arranged at the front opening 2. This can identify the incinerated person or pet. Also, a supporting elemnet 25 for flowers or the like can be provided on the supporting body 7.

It will be understood that each of the elements described above, or two or more together, may also find a useful application in other types of constructions differing from the types described above.

While the invention has been illustrated and described as embodied in self mountable niche for remains ashes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A self-mountable niche for remain ashes, comprising a substantially closed box; a receptacle for accommodating ashes and insertable in said box; a supporting element connected with said box and supporting said box; a fastening and locking element connected with said supporting element for placing the niche at a corresponding location; and means for connecting said box with said supporting element, said means including a plurality of pins arranged on one of said of said box and said supporting element and a plurality of holes formed on another of said box and said supporting element, each of said holes having a wider keyhole-shaped upper part and a narrower lower part, and each of said pins having a wider outer part and a narrower inner part formed so that said wider outer part of each of said pins can pass through said keyhole-shaped upper part of each of said holes and thereafter said narrower part of each of said pins passes in said narrower part of each of said holes.

2. A self-mountable niche as defined in claim 1, wherein said box is formed as a prismatic closed box.

3. A self-mountable niche as defined in claim 1, wherein said box has a front surface provided with a front opening.

4. A self-mountable niche as defined in claim 1, wherein said supporting element is box-shaped and has a front face provided with an opening, said holes being located around said opening and formed so as to allow a tool to engage each of said pins and to tighten said pins.

5. A self-mountable niche for remain ashes, comprising a substantially closed box; a receptacle for accommodating ashes and insertable in said box; a supporting element connected with said box and supporting said box; a fastening and locking element connected with said supporting element for placing the niche at a corresponding location; and means for connecting said box with said supporting element, said means including a plurality of pins arranged on one of said of said box and said supporting element and a plurality of holes formed on another of said box and said supporting element, each of said holes having a wider keyhole-shaped upper part and a narrower lower part, and each of said pins having a wider outer part and a narrower inner part formed so that said wider outer part of each of said pins can pass through said keyhole-shaped upper part of each of said holes and thereafter said narrower part of each of said pins passes in said narrower part of each of said holes, said supporting element having a back face provided with an opening surrounded by a rib which has a plurality of keyhole-shaped holes.

6. A self-mountable niche as defined in claim 5, wherein said fastening and locking element has a shape and a size corresponding to a shape and a size of said back face of said supporting element and is provided with holes for fastening bolts and with pins introducible into said holes of said supporting element.

7. A self-mountable niche as defined in claim 6, and further comprising a retaining plate to said fastening and locking element and preventing lifting of said fastening and locking element.

8. A self-mountable niche for remain ashes, comprising a substantially closed box; a receptacle for accommodating ashes and insertable in said box; a supporting element connected with said box and supporting said box; a fastening and locking element connected with said supporting element for placing the niche at a corresponding location; and means for connecting said box with said supporting element, said means including a plurality of pins arranged on one of said of said box and said supporting element and a plurality of holes formed on another of said box and said supporting element, each of said holes having a wider keyhole-shaped upper part and a narrower lower part, and each of said pins having a wider outer part and a narrower inner part formed so that said wider outer part of each of said pins can pass through said keyhole-shaped upper part of each of said holes and thereafter said narrower part of each of said pins passes in said narrower part of each of said holes, said supporting structure having a front face formed so that a plurality of the niches can be arranged on said front face with said supporting elements arranged one above the other and side by side.

9. A self-mountable niche as defined in claim 8, wherein said supporting structure has a main part for supporting the niches with lower legs and an upper larmier.

10. A self-mountable niche as defined in claim 8, wherein said supporting structure is formed as a funeral module.

* * * * *